US008769897B2

(12) United States Patent
Kikuchi et al.

(10) Patent No.: US 8,769,897 B2
(45) Date of Patent: Jul. 8, 2014

(54) REMAINING FORMWORK FOR DECORATION, AND WALL SURFACE STRUCTURE OF CONCRETE STRUCTURE

(75) Inventors: Takeyasu Kikuchi, Tokyo (JP); Seiichi Fukawa, Tokyo (JP); Kengo Kuma, Tokyo (JP)

(73) Assignees: WPC Corporation, Tokyo (JP); Kengo Kuma and Associates, Tokyo (JP)

( * ) Notice: Subject to any disclaimer, the term of this patent is extended or adjusted under 35 U.S.C. 154(b) by 0 days.

(21) Appl. No.: 14/003,839

(22) PCT Filed: Mar. 10, 2011

(86) PCT No.: PCT/JP2011/055645
§ 371 (c)(1),
(2), (4) Date: Sep. 18, 2013

(87) PCT Pub. No.: WO2012/120679
PCT Pub. Date: Sep. 13, 2012

(65) Prior Publication Data
US 2014/0000200 A1 Jan. 2, 2014

(51) Int. Cl.
*E02D 29/02* (2006.01)
*E04B 2/86* (2006.01)
*E04G 19/00* (2006.01)

(52) U.S. Cl.
CPC ..... *E04G 19/00* (2013.01); *E02D 29/02* (2013.01); *E04B 2/8647* (2013.01)
USPC ..... 52/385; 52/311.1; 52/315; 52/434; 249/15

(58) Field of Classification Search
USPC ..... 52/311.1, 315, 384, 385, 434, 435, 389, 52/314; 249/15, 33, 40, 42
See application file for complete search history.

(56) References Cited

U.S. PATENT DOCUMENTS 1,654,030 A * 12/1927 Ashenhurst ..... 52/342
2,523,131 A * 9/1950 Martin ..... 249/42
2,641,043 A * 6/1953 Martin ..... 249/192
(Continued)

FOREIGN PATENT DOCUMENTS

JP S56-63736 5/1981
JP 09-072029 3/1997
(Continued)

OTHER PUBLICATIONS

International Search Report May 10, 2011.

*Primary Examiner* — Brian Glessner
*Assistant Examiner* — Brian D Mattei
(74) *Attorney, Agent, or Firm* — Cooper Legal Group, LLC

(57) ABSTRACT

The present invention relates to a decorative remaining formwork formed by combining a plurality of single frame plates defined by 3 or more edges comprising one edge arranged horizontally and at least one inclined edge inclined with respect to the horizontal edge; arranging the single frame plates so as to form a predetermined gap in a joint-shape between respective edges of the single frame plates adjacent each other; and having a back plate on a concrete casting surface, the back plate covering the predetermined gap in a longitudinal direction, and being fixed to the single frame plate to connect the single frame plates adjacent each other, and a cross-sectional shape in a width direction of the back plate being formed into a shape enlarged from a contact surface with respect to the single frame plate toward an opposed surface with respect to the contact surface.

14 Claims, 9 Drawing Sheets

(56) References Cited

U.S. PATENT DOCUMENTS

| | | | | |
|---|---|---|---|---|
| 5,761,874 | A * | 6/1998 | Hayakawa | 52/701 |
| 6,360,505 | B1 * | 3/2002 | Johns | 52/311.1 |
| 6,688,066 | B1 * | 2/2004 | Cottier et al. | 52/481.1 |
| 2006/0260269 | A1 * | 11/2006 | Swiszcz et al. | 52/783.1 |
| 2007/0137128 | A1 * | 6/2007 | Viau et al. | 52/388 |
| 2014/0000200 | A1 * | 1/2014 | Kikuchi et al. | 52/384 |

FOREIGN PATENT DOCUMENTS

| | | |
|---|---|---|
| JP | 2000-233067 | 8/2000 |
| JP | 2002-242209 | 8/2002 |
| JP | 2002-322659 | 11/2002 |
| JP | 2003-138580 | 5/2003 |

* cited by examiner

REMAINING FORMWORK FOR DECORATION, AND WALL SURFACE STRUCTURE OF CONCRETE STRUCTURE

FIELD OF THE INVENTION

The present invention relates to a formwork or a monolith used for casting concrete, and a wall surface structure of concrete constructions constructed by using the formwork. More specifically, the present invention relates to a "remaining formwork" being left without removed after casting and curing concrete to become part of the concrete construction, and having effect of decorating a wall surface of a finished concrete construction, i.e., a decorative remaining formwork, and a wall surface structure of a concrete construction constructed by using the decorative remaining formwork.

DESCRIPTION OF THE RELATED ARTS

When foundations and structures of various constructions such as retaining wall, bridge pier, check dam, house and building are built with concrete, construction of such foundations and structures is performed by casting the concrete into a space surrounded by formworks to obtain a concrete construction with a desired shape.

As such formworks used for casting the concrete, plates made of plywood or metal plate bodies or the like are used. Such general formworks are removed from a surface of the concrete construction after the concrete is cast and a period necessary to cure is passed, and then used again as the concrete molding formwork in another construction site and the like.

In the conventional general concrete molding formworks, recovery operations by disassembling the formworks after curing and maintenance activities performed on the occasion of the reuse, such as the elimination of attached concrete and dirt, are complicated. Therefore, the construction by using the formworks called "remaining formwork" which is left as part of a building without removing, is also performed.

As such remaining formworks, formworks formed with a metal formwork, concrete and the like are generally used. However, by way of example, when the concrete construction to be constructed is retaining wall, check dam or the like, remaining formworks with texture closely resemble in living rock and wood on a surface opposite to a concrete casting surface of the remaining formworks are used so that these concrete constructions which are artifacts can blend with the scene without damaging the natural scenery.

As an example of such decorative remaining formworks, there have been proposed a decorative remaining formwork giving decorative effect by attaching logs of thinned wood as decoration materials to a surface opposite to a concrete casting surface of a main body of the remaining formwork made of lightweight concrete (see Patent Documents 1, 2), and a decorative remaining formwork using a panel made by bonding wooden chips and urethane powder with an adhesive then formed into a plate-shaped as a main body of the decorative remaining formwork, instead of the above mentioned lightweight concrete, for lightweighting the decorative remaining formwork and the like, and logs of thinned wood is attached to a surface opposite to a concrete casting surface of the main body of the remaining formwork body (Patent Document 3).

DOCUMENTS OF RELATED ART

Patent Documents

Patent Document 1: JP 2002-242209 A
Patent Document 2: JP 2002-322659 A
Patent Document 3: JP 2003-138580 A

DISCLOSURE OF THE INVENTION

Problem to be Solved by the Invention

The conventional decorative remaining formworks formed as described above comprise a main body served as a formwork and logs of thinned wood as decoration materials attached to one surface of the main body. Accordingly, because of the attached decoration materials, the above decorative remaining formworks are thicker, bulky and heavier than the conventional general formwork.

Therefore, in this kind of remaining formwork, due to labor and costs wasted for transportation and a thickness and heavy weight thereof, the workability of installation operations in the construction site also decreases.

Further, due to the heavy weight as described above, the remaining formworks have a risk to be peeled and fallen from the surface of the concrete construction by self-weight after construction.

Furthermore, the conventional decorative remaining formwork has a configuration such that a main body is formed into a rectangle shape, and decoration materials also formed into a rectangle shape is attached to one side of the rectangular main body. As a result, the wall surface of the completed concrete construction can be decorated only as continuation of the rectangle shapes. Therefore, in such decorative remaining formwork by attaching the logs of thinned wood as the decoration materials, monotonous design using natural texture of which the decoration materials themselves have, can be expressed. However, even if more complicated and unique design is intended, the design which can be expressed is restricted.

Therefore, an object of the present invention, which has been made to solve the above mentioned problems of the conventional art, is to provide a decorative remaining formwork which has a relatively simple configuration, accordingly, lightweight and thin, is easy to handle during transportation and construction and can express more complicated and various designs; and a wall surface structure of the concrete construction formed by using the above mentioned decorative remaining formwork.

Means for Solving the Problems

Means for solving the problem are described below with reference numerals in the embodiments of the present invention. These reference numerals are intended to clarify the correspondence between the descriptions in the claims and the descriptions in the embodiments of the present invention, and it is needless to say that these reference numerals should not be used to restrictively interpret the technical scope of the claims of the present invention.

In order to achieve the above objectives, a decorative remaining formwork 1 according to the present invention is formed by combining a plurality of single frame plates defined by 3 or more edges comprising one edge 10*a*. 20*a* arranged horizontally and at least one inclined edge 10*b*, 20*b* inclined with respect to the horizontal edge 10*a*, 20*a*, arranging the single frame plates 10, 20 so as to form a predetermined gap δ in a joint-shape between respective edges of the single frame plates 10, 20 adjacent each other, and having a back plate 30 on a concrete casting surface, the back plate 30 covering the predetermined gap δ in a longitudinal direction, and being fixed to the single frame plates 10, 20 to connect the single frame plates 10, 20 adjacent each other, and a cross-sectional shape in a width direction of the back plate 30 being formed into a shape enlarged from a contact surface 31 with respect to the single frame plate 10, 20 toward an opposed surface 32 with respect to the contact surface 31 (see FIG. 6).

The decorative remaining formwork 1 with the above mentioned structure may comprise a base unit U formed by a combination of two single frame plates 10, in a predetermined shape forming a predetermined rectangle shape by arranging the inclined edges 10*b*, 20*b* in parallel via the predetermined gap δ, and having a pattern expressed by continuously arranging the base units U in a predetermined direction or by continuously arranging the base units U of which the directions are reversed and rotated or reversed or rotated in a predetermined pattern.

In this case, a basic shape is defined as shapes of the two single frame plates 10, 20 constituting the base unit U, and the decorative remaining formwork 1 may comprise a component part composed of a single frame plate 10*x*, 20*x* with a shape removing a part of the single frame plates 10, 20 in the basic shape (see FIG. 1).

Furthermore, in the above decorative remaining formwork 1, the single frame plates 10, 20 in different colors (in FIG. 1, three colors, that is, white, light gray and dark gray) may be mixed.

In this case, the single frame plates 10, 20 adjacent each other have a uniform color to express a pattern by a combination of the single frame plates 10, 20 adjacent each other in the uniform color to the decorative remaining formwork 1.

The single frame plate 10, 20 and/or the back plate 30 may be formed of a synthetic wood board obtained by forming synthetic resin filled with wood meals in a plate shape.

Furthermore, a wall surface structure of a concrete construction according to the present invention is a concrete construction formed by using any of the above mentioned decorative remaining formwork 1, and a surface of the concrete construction is covered with the decorative remaining formwork 1, and the back plate 30 of the decorative remaining formwork 1 is buried into a hardened concrete.

The decorative remaining formwork 1 may be fixed to one end 70*a* of a separator 70 buried into the concrete of the concrete construction.

After removing a form tie 50 (see FIGS. 8, 9), the decorative remaining formwork 1 may be fixed to the separator 70 by threadedly engaging a nut (not shown) to an axial screw 41 of a frame plate distance regulation body (cone) 40. The cone 40 is attached to one end 70*a* of the separator 70, and the axial screw 41 passes through and protrudes from the single frame plate 10, 20.

Effect of the Invention

By the above mentioned configuration, in the decorative remaining formwork 1 according to the present invention and the wall surface structure of the concrete construction constructed by using this decorative remaining formwork 1, the following prominent effects can be obtained.

The remaining formwork 1 is formed by combining a plurality of single frame plates 10, 20 with one edge 10*a*, 20*a* arranged horizontally and at least one inclined edge 10*b*, 20*b* inclined with respect to the horizontal edge 10*a*, 20*a*, and, after casting and curing the concrete, the remaining formwork 1 is left without removed. As a result, with a pattern expressed by the combination of the single frame plates 10, 20, decoration with a complicated pattern that cannot be expressed by the conventional remaining formwork, can be performed.

Furthermore, in the decorative remaining formwork 1 of the present invention, the pattern is expressed by the combination of the above mentioned single frame plates 10, 20. Accordingly, unlike the decorative remaining formworks described as the conventional art, it is not necessary to stick the decoration materials such as thinned wood of log, to the surface (outer surface) opposite to the concrete casting surface, and the remaining formwork 1 has simple and lightweight structure to be transported and constructed easily.

Moreover, in the decorative remaining formworks 1 of the present invention, a cross-sectional shape of a width direction of the back plate 30 connecting between the single frame plates 10, 20 is formed into a shape enlarged from a contact surface 31 with respect to the single frame plate 10, 20 toward an opposed surface 32, as shown by way of example in FIG. 6, in a trapezoid. Therefore, by hardening the concrete in the state where the back plate 30 is buried, the back plate 30 cannot be taken out of the concrete and the decorative remaining formwork 1 can be appropriately prevented from being fallen from the wall surface of the constructed concrete construction.

Particularly, in the decorative remaining formwork 1 according to the present invention, since each edge of each single frame plate 10, 20 is fixed to the back plate 30, all single frame plates 10, 20 are fixed to the concrete wall via the back plate 30 at entire peripheries of the single frame plate 10, 20. Therefore, each single frame plate 10, 20 also becomes hard to fall from the wall surface.

A pattern expressed by continuously arranging the above mentioned base units U is given to the decorative remaining formwork 1 according to the present invention. Accordingly, the pattern can be changed relatively easily by changing a direction of the base unit U.

In this case, a basic shape is defined as shapes of the two single frame plates 10, 20 constituting the base unit U, and the decorative remaining formwork 1 may comprise a component part composed of a single frame plate 10*x*, 20*x* (see FIG. 1) with a shape removing a part of the single frame plate 10, 20 in the basic shape (see FIG. 1). Accordingly, for example, when a window and/or an entrance is/are formed in the concrete construction as shown in FIG. 1, the single frame plate constituting a periphery of this window and/or entrance is/are formed with a single frame plate 10*x*, 20*x* shaped by removing a part of the single frame plate 10, in the basic shape as described above. As a result, the decorative remaining formwork 1 corresponding to a shape of the concrete construction to be constructed can be formed without hindering continuity of the patterns and the like.

When the single frame plates in different colors are used in combination, the pattern appeared on the wall surface of the concrete construction can be expressed not only by a pattern produced by outline shapes of the above mentioned single frame plates but also by the difference in color. As a result, the decorative remaining formwork with more excellent designability can be provided.

Particularly, since a plurality of single frame plates 10, 20 adjacent each other has a uniform color, patterns can be expressed in combination of the adjacent single frame plates 10, 20 with uniform color, and complicated patterns can be relatively easily expressed.

When the single frame plate 10, 20 is a synthetic wood board obtained by forming synthetic resin filled with wood meals into a plate-shape, the natural texture closely resemble in wood can be given by adding the wood meals, and the synthetic wood board formed into this way is resistant to corrosion and insect pests unlike a natural wood and can be formed into a relatively lightweight, while having necessary strength.

Since the single frame plate 10, 20 is formed of the above mentioned synthetic wood board, incombustibility can be provided by adding a flame retardant into a molding material or the like while wood-like texture is given to the outer wall of the house or the like. As a result, unlike the case where a flammable real wood is used for the outer wall of the house, there is no risk of fire spreads and the like. Moreover, by adding a pigment or the like into the molding material, it is relatively easy to color the single frame plate in any color, and there is no discoloration due to peeling off of a coating film unlike when painting the single frame plate.

BRIEF DESCRIPTION OF THE DRAWINGS

FIG. 3 (A) is a triangle, FIG. 3 (B) is a quadrangle, FIG. 3(C) is a pentagon;

FIG. 7 (A) shows an arrangement pattern common to FIG. 1, FIGS. 7 (B) to (E) show variations of arrangement pattern using the base units common to FIG. 7 (A), and FIGS. 7 (F) to (H) show variations of arrangement pattern using base units different from those of FIG. 7 (A), respectively;

BEST MODE FOR CARRYING OUT THE INVENTION

A preferred embodiment of the present invention will be described below with reference to the accompanying drawings.

Overall Structure of Decorative Remaining Formwork

Figure 1:
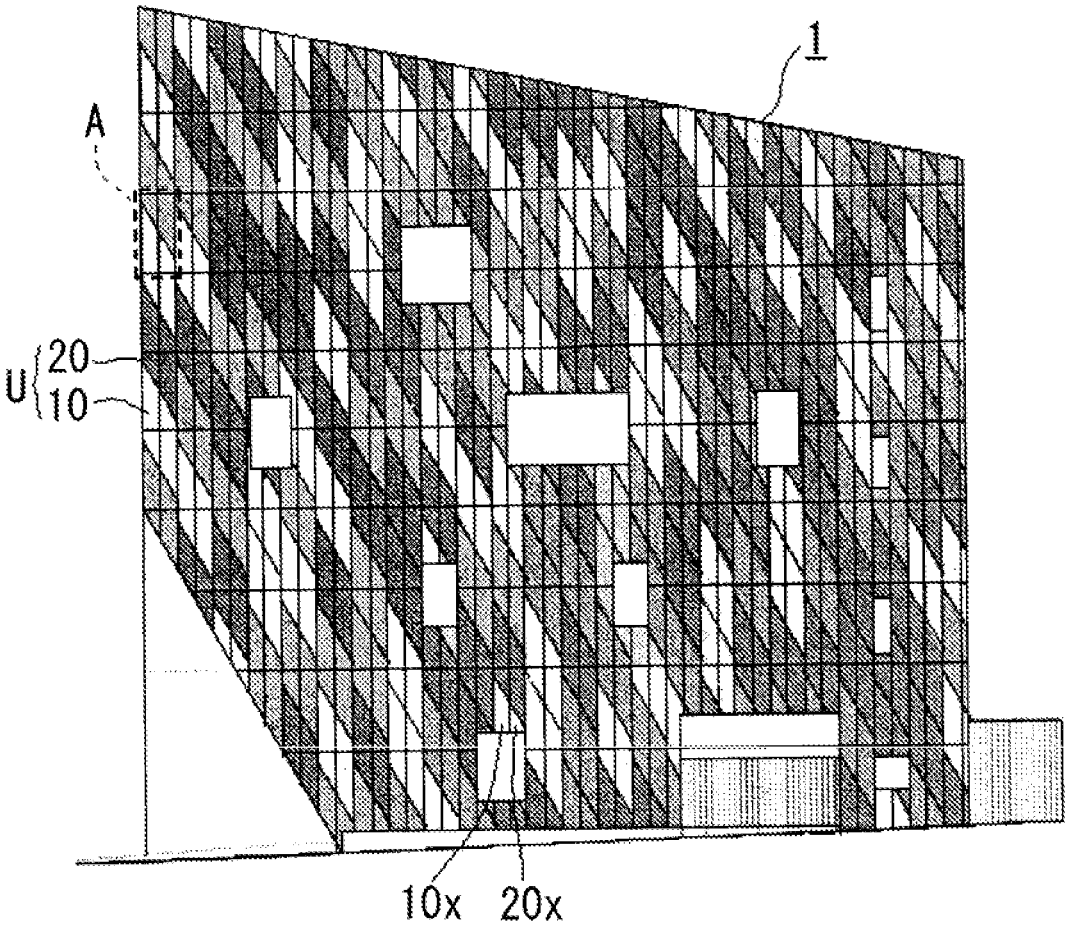
FIG. 1 is a side elevational view of a building constructed by using a decorative remaining formwork according to the present invention.
Figure 2:
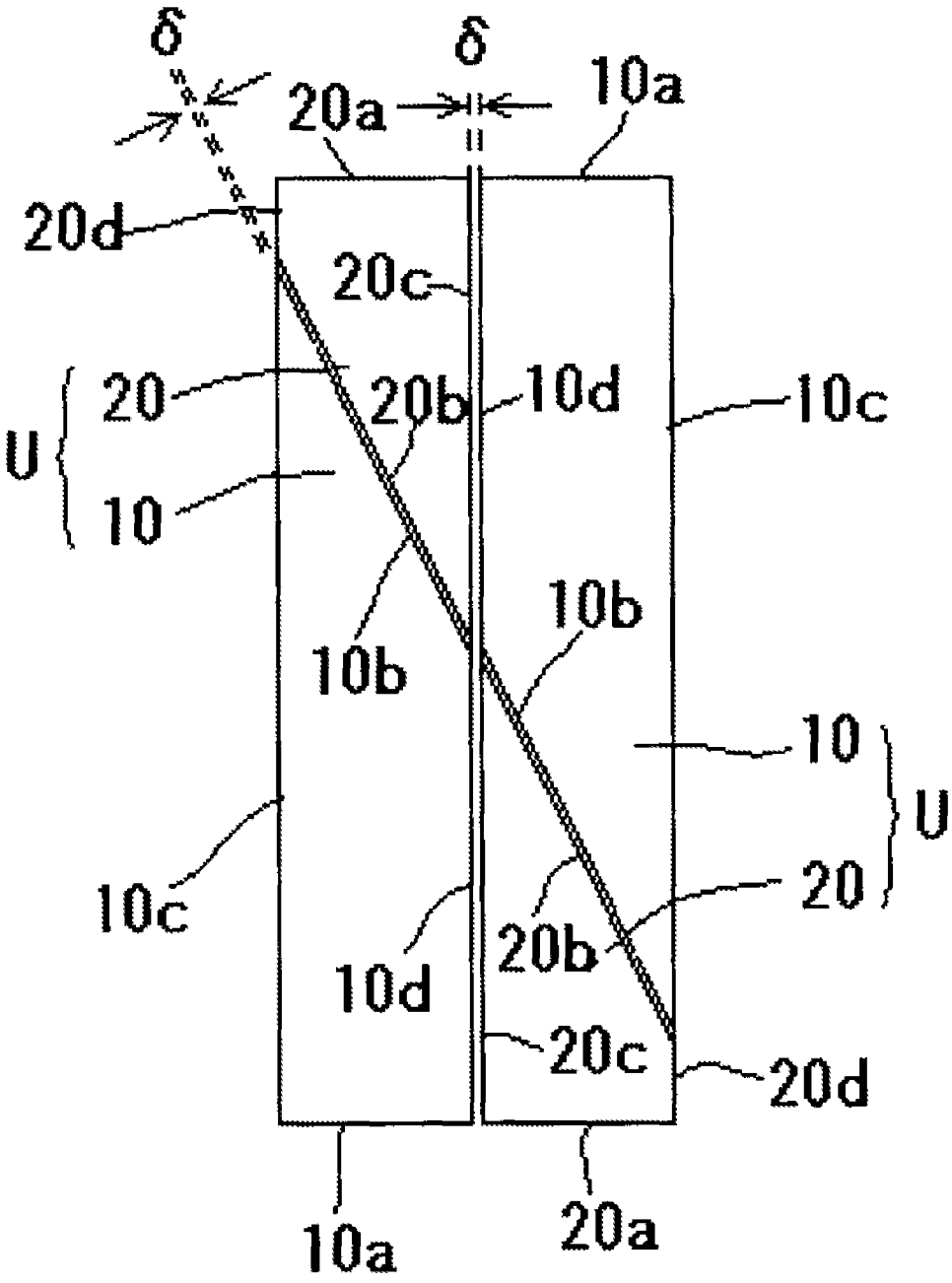
FIG. 2 is an enlarged illustrative view of A part in FIG. 1.
Figure 5:
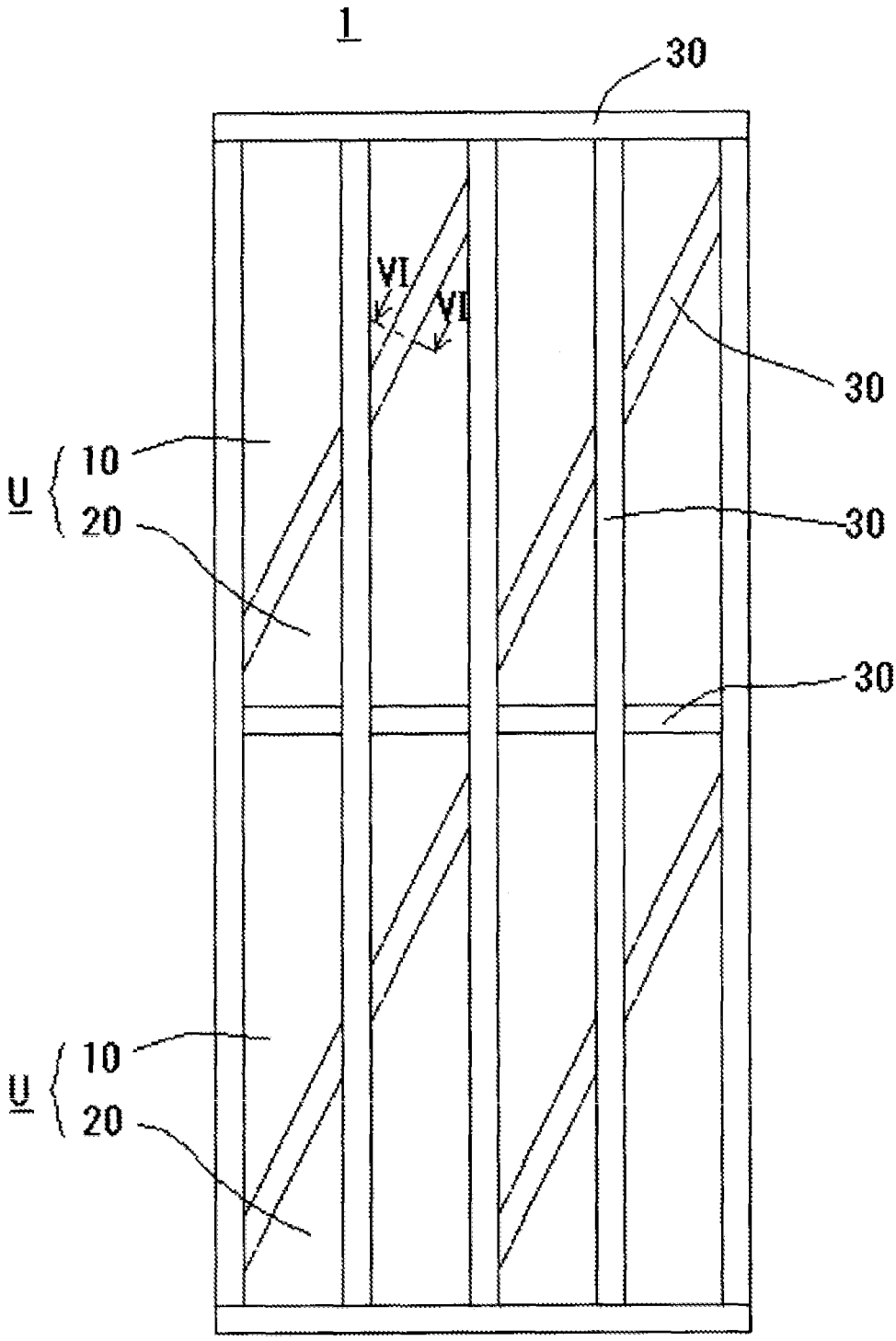
FIG. 5 is a rear view of the remaining formwork in which a predetermined number (eight pairs) of base units are combined.
Figure 6:
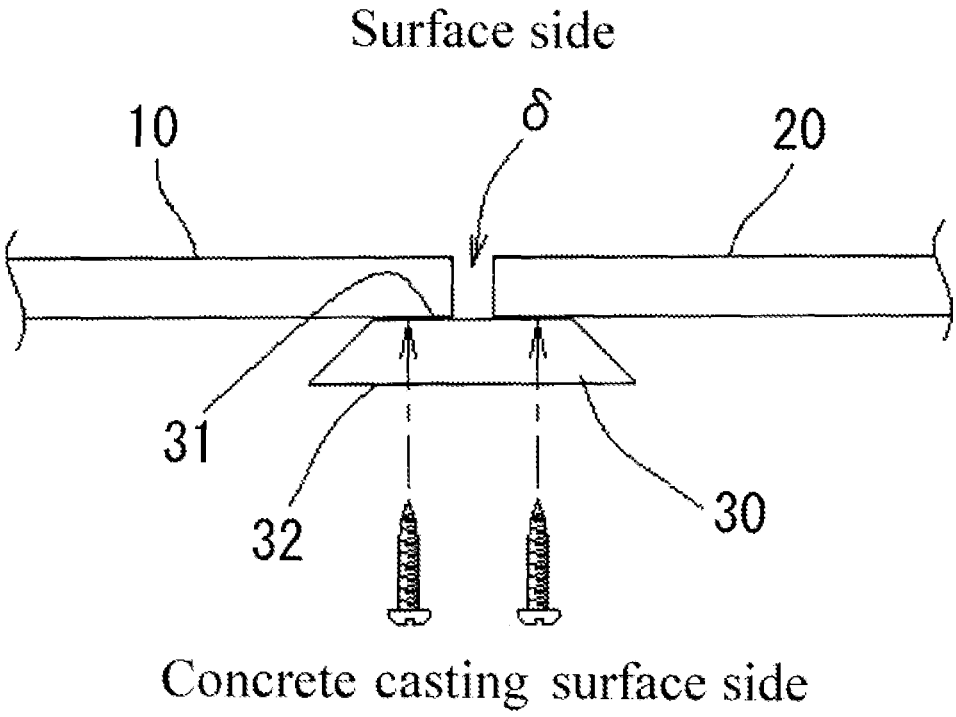
FIG. 6 is a cross-sectional view along a line VI-VI of FIG. 5.

As shown in FIGS. 1 and 2, a decorative remaining formwork 1 according to the present invention is formed by means of a combination of a back plate 30 and single frame plates 10, 20 connected by the back plate 30, by arranging a plurality of the single frame plates 10, 20 with one edge arranged horizontally (a horizontal edge 10*a*, 20*a*) and an inclined edge 10*b*, 20*b* inclined with respect to the horizontal edge 10*a*, 20*a* so that each edge of the single frame plates 10, 20 is parallel to each edge of adjacent single frame plates via a predetermined gap δ; covering the gap δ formed between the single frame plates 10, 20 with the back plate 30 from a concrete casting surface side, as shown in FIGS. 5 and 6; and fixing a periphery of each single frame plate 10, 20 to the back plate 30 by screwing or the like.

In an embodiment illustrated in the accompanying drawings, when the single frame plates 10, 20 are arranged in pairs to make the inclined edges 10*b*, 20*b* parallel via the predetermined gap δ, a combination of the single frame plates configured to form a predetermined rectangle shape (in the present embodiment, by way of example, rectangle shape of 280 mm wide, 1,415 mm long) in pairs is defined as a base unit U so that the desired surfaces can be covered by assembling the base units U.

The size of the base unit is modifiable as appropriate depending on scale and the like of the concrete construction to be constructed, and for example, several kinds of base units with different height may be provided (by way of example, in the present embodiment, three types; 1,390 mm, 1,415 mm and 1387.5 mm).

As described above, when the base units of a plurality of sizes are provided, the formwork may be formed only by a combination of the base units of the common size, or the formwork may be formed by a combination of several types of the base units with different size. For example, the sizes of the base units may be different depending on height at which each base unit is arranged.

In the present embodiment, by way of example, the base units with different size are respectively used in a low-stratum area (for example, the first and second tiers from the bottom), a middle-stratum area (the third and fourth tiers from the bottom) and an upper-stratum area (above the fifth tier from the bottom), thus, a height of each stratum area is different among the three-stratum areas according to the order of the low-stratum, the middle-stratum and the upper-stratum areas. Thus, the base units of 1,390 mm, 1,415 mm and 1387.5 mm high are respectively used so as to adapt to the height of each stratum area.

Such a combination may be adequately determined for various purposes.

Single Frame Plate

When concrete is cast, the above mentioned single frame plates 10, 20 support pressure of the cast concrete to mold a concrete construction into a predetermined shape, and after casting and curing the concrete, the single frame plates 10, 20 are remained on a surface of the concrete construction to be served as a decorative surface. Therefore, the single frame plates 10, 20 should have the strength that can stand pressure of the concrete as a framework while exhibiting the decorativeness even if remained after casting and curing.

Further, since the single frame plates 10, 20 are remained on the surface of the concrete construction to become part of the concrete construction, it is required that the single frame plates 10, 20 are resistant to corrosion and insect pests, and it is also preferable that the single frame plates 10, 20 have a relatively thin thickness and are lightweight to reduce a load to the wall surface and to improve transportability and workability.

In the present embodiment, to satisfy the above mentioned demands required to the single frame plates 10, 20, a molded material is composed by adding wood meals to synthetic resin, then formed into a board having the thickness of 15 mm to obtain a synthetic wood board, then, the synthetic wood board is cut into predetermined sizes to form the single frame plates 10, 20.

Thus, by producing the single frame plates 10, 20 from the synthetic wood board, texture closely similar to natural wood can be given to the single frame plates 10, 20, while ensuring the strength which is required for the formwork for concrete molding. As a result, the decorative effect can not only be enhanced, but high resistance to corrosion and insect pests can also be shown to eliminate exchange operations and so on due to corrosion or the like after construction.

Furthermore, the single frame plates 10, 20 formed of the synthetic wood board have advantageous properties in using as outer wall materials of building, which do not exist in natural wood, such as relative ease of giving flame retardancy and coloring in any color by adding a flame retardant and a pigment to a molding material.

Moreover, because the synthetic wood board composed by adding wood meals is more lightweight than a plate formed only of the synthetic resin, it is superior in transportation costs and handleability.

Each single frame plate 10, 20 is defined by 3 or more edges comprising one edge 10*a*, 20*a* arranged horizontally and an inclined edge 10*b*, 20*b* inclined with respect to the horizontal edge 10*a*, 20*a*. The single frame plate 10, 20 may be formed into various shapes, by way of example, triangle which is defined by three edges comprising one edge 10*a* (20*a*) arranged horizontally, an inclined edge 10*b* (20*b*) inclined with respect to the horizontal edge 10*a* (20*a*) and one edge 10*c* (20*c*) in the height direction (see FIG. 3 (A)); quadrangle defined by four edges comprising one edge 10*a* (20*a*) arranged horizontally, an inclined edge 10*b* (20*b*) and two edges 10*c*, 10*d* (20*c*, 20*d*) in the height direction (see FIG. 3 (B)); and pentagon having a truncated shape comprising a horizontal edge 10*e* (20*e*) which is formed by further cutting top part horizontally in addition to four edges of 10*a* to 10*d* (20*a* to 20*d*) forming the quadrangle shown in FIG. 3 (B) (see FIG. 3 (C)).

Figure 3:
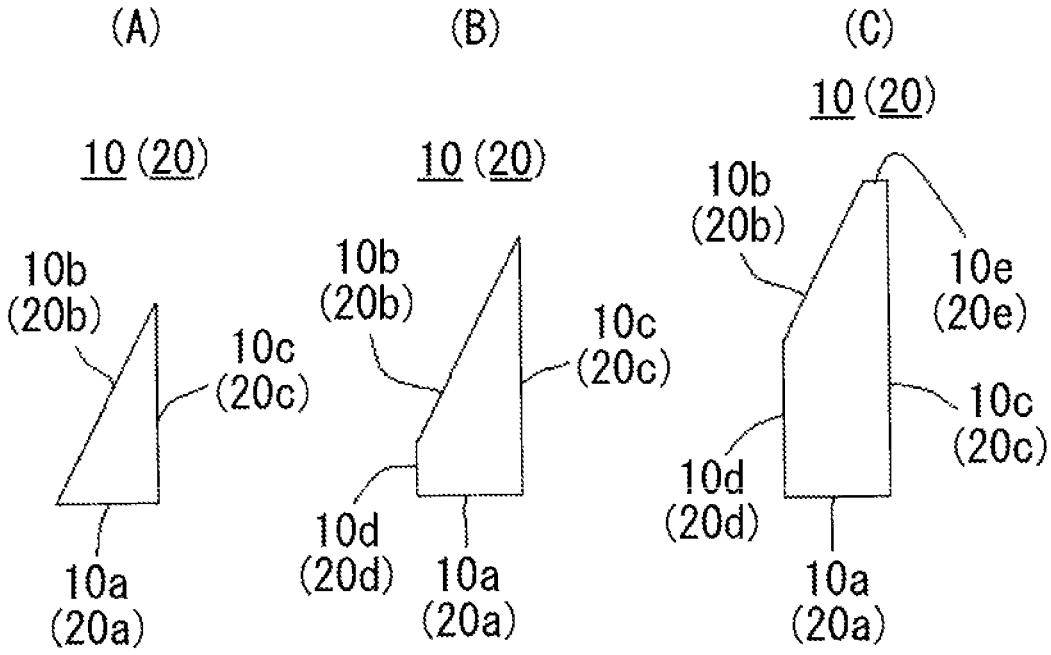
FIGS. 3 (A) to (C) are illustrative views showing examples of the shape of a single frame plate.

In the shapes of the single frame plates 10, 20 shown in FIGS. 3 (A) to (C), the edges 10*c*, 10*d* (20*c*, 20*d*) in the height direction may intersect with the above mentioned one edge 10*a* (20*a*) in the horizontal direction at an any angle. However it is preferable that each edge 10*c*, 10*d* (20*c*, 20*d*) in the height direction is vertical edges intersecting with one edge 10*a* (20*a*) in the horizontal direction at a right angle in pairs, as shown in FIGS. 3 (A) to (C).

Each single frame plate 10, 20 forming the decorative remaining formwork 1 according to the present invention can be formed into different shapes. However, in consideration of processability and workability, all of the single frame plates may be in the same shape. Or, the remaining formwork 1 may be formed by a combination of the single frame plates in several kinds of shapes.

In the present embodiment, two shapes are determined as the basic shape of the single frame plate constituting a base unit U. The two basic shapes are a shape corresponding to one single frame plate 10 which is one of the two single frame plates 10, 20, and a shape corresponding to the other single frame plate 20 (when a plurality of base units U with different size are provided, two shapes for each type of the base units U).

As the single frame plates 10, 20 used at positions where a window and/or an entrance of the building are/is formed, and at left, right, top and bottom ends of the building to be constructed, single frame plates 10*x*, 20*x* shaped by removing a part of the above mentioned basic shape may be used, thereby continuity of patterns formed by arrangements of the base units U is ensured.

Such single frame plates 10, 20 may all be formed in the same color, but it is preferable that several kinds of single frame plates 10, 20 in different colors are prepared. As described above, by preparing several kinds of single frame plates 10, 20 in different colors, due to variations of color scheme patterns, patterns which can be expressed on the surface of the decorative remaining formwork 1 can be largely increased, accordingly, more improved design can be achieved.

In the present embodiment, for two kinds of the single frame plates 10, 20 respectively, single frame plates in three different colors are prepared, so as to express patterns on the surface of the decorative remaining formwork 1 by a combination of the color scheme patterns of the single frame plates 10, 20 in three colors.

The single frame plates 10, 20 may all have the same color, may be formed in two colors or may be formed by a combination of three or more colors, as described above.

Base Unit

In the decorative remaining formwork 1 according to the present embodiment, the base unit U is a combination of two single frame plates 10, 20 in different shapes which forms a predetermined rectangle shape (in the present embodiment, rectangle shape of 280 mm*1,415 mm) when the inclined edges 10*b*, 20*b* are arranged in parallel via the predetermined gaps δ. In the present embodiment, the predetermined pattern is formed on the decorative remaining formwork 1 by arranging the base units U in a predetermined pattern.

In the following description, an example in which the decorative remaining formwork 1 is formed in total by combining the plurality of base units U with uniform size is given. However, as described above, several kinds of the base units U with different sizes (in the above mentioned example, three units to form rectangle shapes; 280 mm*1,390 mm, 280*1.415 mm and 280 mm*1387.5 mm) are prepared and then the decorative remaining formwork 1 may be formed by combining two or more of the base units U with different sizes.

Figure 4:
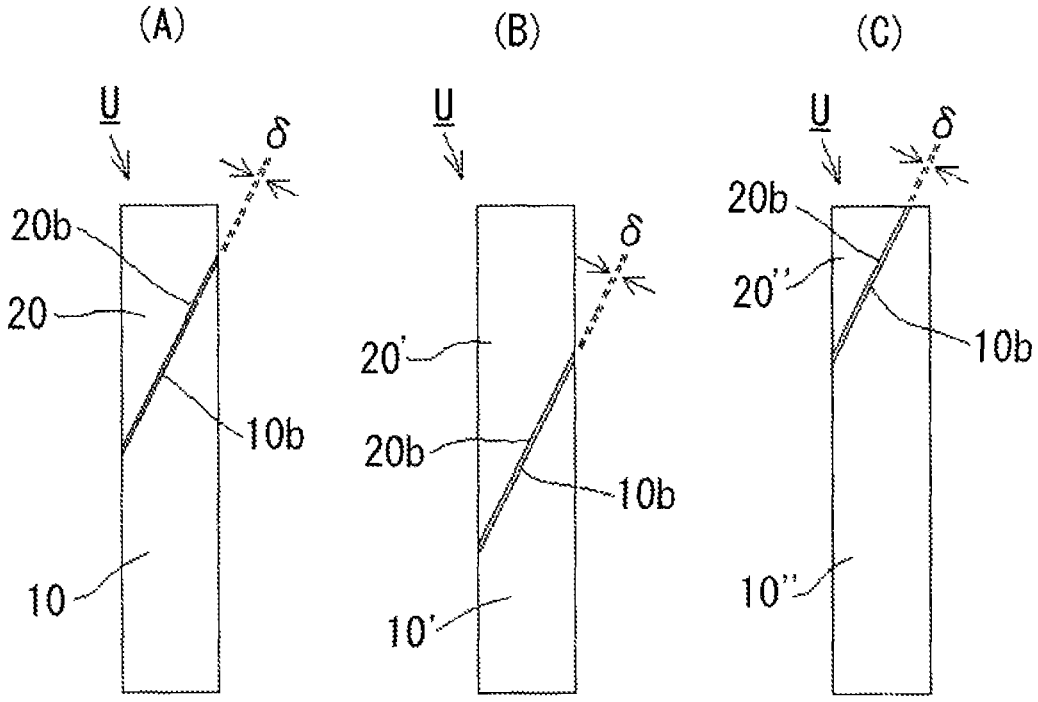
FIGS. 4 (A) to (C) are illustrative views which show shapes of combination of two single frame plates forming a base unit, and FIGS. 4 (A) to (C) respectively show a variation.

In the present embodiment, as shown in FIG. 4 (A), the base unit U is formed by a combination of two quadrangles in different shapes, in which each single frame plate 10, 20 constituting the base unit U is formed so that both the inclined edges 10*b*, 20*b* of each frame 10, 20 intersect with one edge in a width direction of a rectangle shape formed by the base unit U (one edge on the left side of the drawing) at a center part of a lengthwise direction of the rectangle shape. However, a combination of the single frame plates 10, 20 forming the base unit U is not limited to the combination of the shape shown in FIG. 4 (A). For example, two single frame plates 10', 20' may be formed into the same shape as shown in FIG. 4 (B), or one single frame plate 10" may be formed into a pentagon, while the other single frame plate 20" may be formed into a triangle as shown in FIG. 4 (C).

In the decorative remaining formwork 1 according to the present embodiment, the above mentioned base unit U is treated as a minimum pattern, and the predetermined pattern is expressed by continuously arranging the base units U. However, this does not means to limit the present invention to the decorative remaining formwork 1 entirely formed by the above mentioned base units U.

Namely, by way of example, when a concrete construction constructed by the decorative remaining formwork 1 according to the present invention is a wall surface of a reinforced concrete house, openings that are not covered with the decorative remaining formwork 1 must be provided at parts corresponding to positions on the wall surface where a window and/or a doorway are/is formed, as shown in FIG. 1.

Therefore, the base units U arranged at the periphery of the positions where the openings are to be formed, have the shape in which a part of the base unit U is cut, and, at the positions, the single frame plates 10*x*, 20*x* shaped by removing a part of the above mentioned two basic shapes of single frame plate 10, are used.

Thus, using the single frame plates 10*x*, 20*x* shaped by removing a part of the above mentioned basic shapes as described above enables windows, doorway and the like to be formed without hindering continuity of the patterns expressed on the decorative remaining formwork 1.

Back Plate

As described above, after the inclined edges 10*b*, 20*b* are arranged in parallel via the predetermined gap δ so that two single frame plates 10, 20 constituting the base unit U form the predetermined rectangle shape in pairs, the above mentioned gap δ is covered with a back plate 30 in the longitudinal direction from a back surface (concrete casting surface) side to fix each end edge at the inclined edges 10*b*, 20*b* of two single frame plates 10, 20 to the back plate 30, thereby two single frame plates 10, 20 are connected by the back plate 30 (see FIGS. 5 and 6).

Further, by continuously arranging the above mentioned each base unit U via the predetermined gap δ, a joint-shaped gap δ formed between the single frame plates 10, 20 forming one base unit U and the single frame plates 10, 20 forming the other adjacent base unit U, is also covered with the back plate 30 from the concrete casting surface to fix the single frame plates 10, 20 to the back plate 30, thereby the adjacent single frame plates 10, 20 are connected and the remaining formwork 1 is formed by repeating the operations.

The back plate 30 is formed into a shape enlarged from a contact surface 31 with respect to the single frame plates 10, 20 towards an opposed surface 32 opposed to the contact surface 31 in a cross section of a width direction thereof so that the back plates 30 are buried into hardened concrete after casting the concrete and cannot be taken out of the concrete. In the present embodiment, by way of example, the above mentioned back plate 30 whose cross section of the width direction is formed into a trapezoid are used as shown in FIG. 6.

The back plate 30 is fixed to the single frame plates 10, 20 in contact with both adjacent single frame plates 10, 20 by screwing or the like so as to cover the gap δ from the concrete casting surface, thereby two adjacent single frame plates 10, 20 are connected via the back plate 30.

In the embodiment shown in FIG. 6, the back plate 30 is fixed to the single frame plates 10, 20 by screws driven from the back plate 30 side. However, conversely, for example, both parts may be fixed by driving the screws from the surface of the single frame plates 10, 20.

If the screw is driven from the surface of the single frame plates 10, 20 as described above, workability can be improved when all or part of single frame plates 10, 20 should be removed for some reason after construction.

However, in this configuration, a head of the screw appears on the outside surface of the remaining formwork thus spoil beauty. Therefore, it is preferable that the screw is driven from the back plate 30 side that is the concrete casting surface when decorativeness of the decorative remaining formwork is more important.

The back plate 30 used in the present embodiment is formed of the synthetic wood board obtained by producing the molded material consisting of synthetic resin filled with wood meals as well as the above mentioned single frame plates 10, 20. In the present embodiment, by way of example, the trapezoid appeared in the cross section of the width direction is formed with the long side of 70 mm, the short side of 60 mm and the board thickness of 20 mm. However, quality of material, shape and dimension of the back plate 30 are not limited to the configuration of the present embodiment. Depending on scale and the like of the concrete construction constructed by the formwork, the quality of material, the shape, the dimension and the like may be changed.

It is preferable that the back plate 30 connecting between the base units U adjacent in the width direction is formed relatively long, so that every connection of a plurality of the base units U placed vertically is carried out by a series of back plates 30 as shown in FIG. 5.

By using the back plate 30 formed long and common to a plurality of base units U placed vertically as described above, strength of the obtained remaining formwork 1 can be enhanced as a whole.

In the concrete casting surface of the decorative remaining formwork 1 obtained by connecting between each single frame plate 10, 20 with the back plate 30 in this way, the above mentioned back plates 30 form lattice-like arrangement around each base unit U as shown in FIG. 5 and the back plates 30 to connect between the inclined edges 10*b*, 20*b* of two single frame plates 10, 20 constituting each base unit U are placed obliquely in each cell of the lattice to play a role in improving strength of the decorative remaining formwork 1 as a whole by showing the same function as a so-called "brace".

Furthermore, since all edges of each single frame plate 10, 20 are fixed to the back plates 30 which are buried into the concrete to prevent extraction, each single frame plate 10, 20 is not fallen from the wall surface of the constructed concrete construction.

Expressed Pattern

In the decorative remaining formwork 1 according to the present invention formed as described above, by arranging the base units U in various patterns, patterns are formed by boundaries between each single frame plate 10, 20 which are expressed by the joint-shaped gaps δ provided between each single frame plate 10, 20. Furthermore, by selecting the color of the single frame plates 10, 20 arranged in each position, various patterns may be expressed through visually associating combination of a plurality of single frame plates 10, 20.

By way of example, arrangement patterns of base units U in the embodiment shown in FIG. 1 will be described with reference to FIG. 7 (A). In the arrangement patterns, base units arranged in the predetermined direction and base units in 180 degrees clockwise rotated direction to the above mentioned base units are alternately arranged in the horizontal direction (direction of rows a to d) and also continuously arranged in the same height direction (direction of the first to fourth tiers).

A combination of four (4) single frame plates (gray-colored parts in the drawing), which are adjacent at boundaries of four base units (by way of example, a row, the first tier; a row, the second tier; b row, the first; and b row, the second tier) and form a rhombus as a whole, is formed in uniform color to express a rhombus pattern, and by producing such rhombus patterns in three different colors at random, predetermined patterns are expressed (see FIG. 1).

As described above, complicated patterns can be expressed by selecting the arrangement of base units and the color of each single frame plate.

In the embodiment shown in FIG. 1, the base units U are arranged in the above mentioned pattern and the color scheme patterns of single frame plates 10, are selected so that rhombus patterns are expressed. However, even if the same arrangement of base units is adopted, the patterns which give a completely different impression can be expressed by changing the coloring pattern.

Further, even if using the base units U in the same shape as those described with reference to FIG. 7 (A), the patterns which give a completely different impression from those described with reference to FIGS. 1 and 7 (A) can be expressed. For example, as shown in FIG. 7 (B), all base units U are arranged in the same direction with respect to both of the horizontal and vertical directions. Furthermore, as shown in FIGS. 7 (C) to (E), the base units arranged in the predetermined direction; base units reversed horizontally or vertically from said predetermined direction; and base unites further rotated 180 degrees in clockwise from said predetermined direction or said reversed direction, are combined in predetermined patterns.

Figure 7:
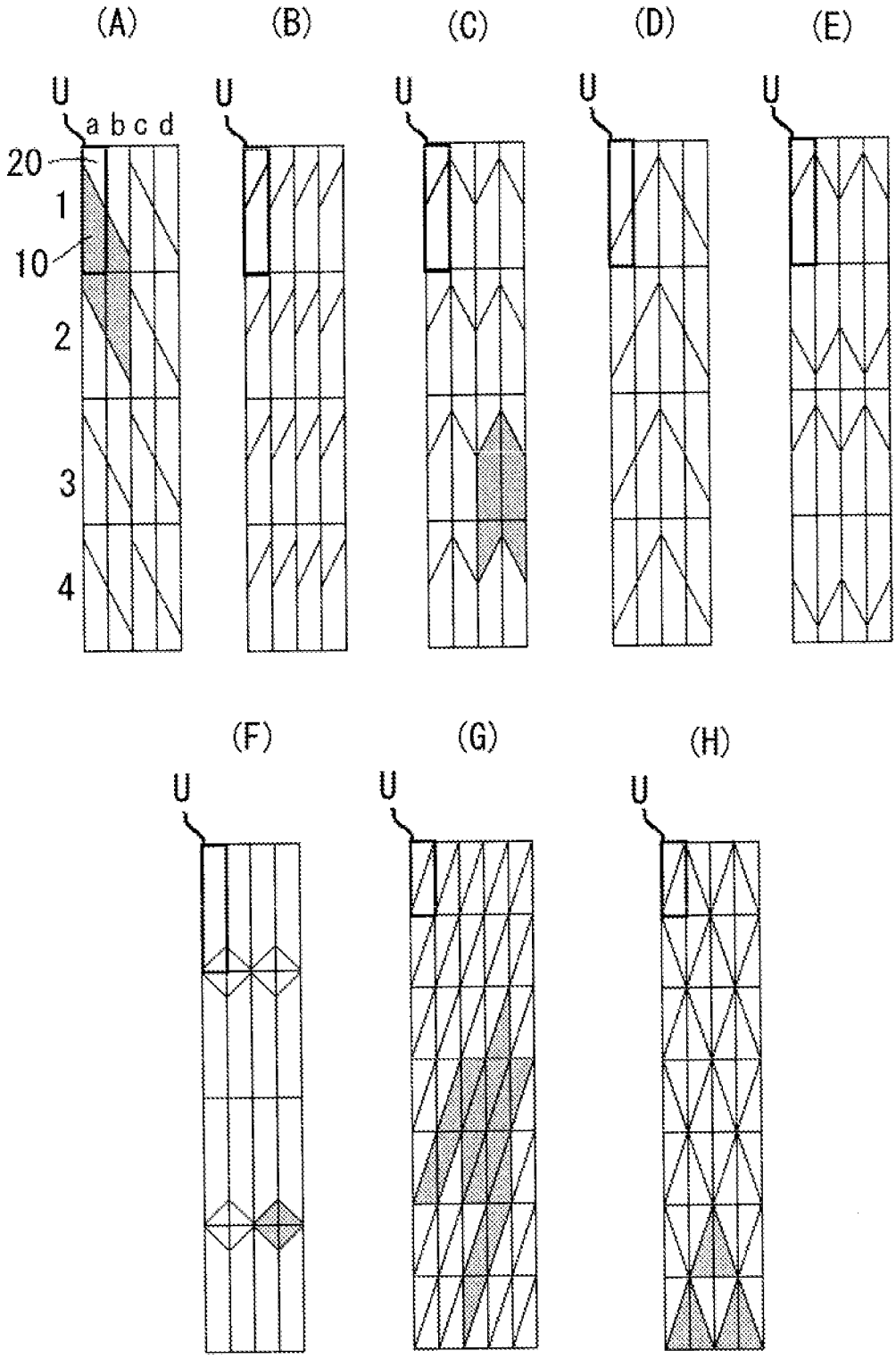
FIGS. 7 (A) to (H) are illustrative views of an arrangement pattern of base units.

Furthermore, by changing the shape of one or both of single frame plates 10, 20, each base unit may be arranged in patterns as shown by way of example in FIGS. 7 (F) to (H).

Moreover, by combining arrangement of the color on each single frame plate 10, 20 with the patterns formed as described above, design expressed with the decorative remaining formwork according to the present invention has no limits, and an example of the patterns which can be expressed extremely easily may include running patterns adopted as patterns of kimono or the like, such as "Yagasuri" (arrow pattern) (see FIG. 7 (C)), "Soroban Shibori" (hexagonal pattern) (see FIG. 7 (F)), "Chidori Goushi" (hound's-tooth check) (see FIG. 7 (G)), and "Urokogata" (squamate pattern) (see FIG. 7 (H)).

Example of Construction

An example of construction of the concrete construction using the above mentioned decorative remaining formwork 1 according to the present invention is described with reference to FIGS. 8 and 9.

The above mentioned each single frame plate 10, 20 and back plates 30 are manufactured by cutting the synthetic wood board into the above mentioned basic shape in a manufacturing plant or the like, and then are carried into a building site, for example after marking a mounting position and a mounting direction on concrete casting surface side to show arrangement of each single frame plate 10, in accordance with design.

As described above, when the single frame plate shaped by removing a part of the basic shape, etc. is used in the position where a window is formed and the like, such uniquely-shaped single frame plate may be prepared by removing the single frame plates in the above mentioned basic shape during field operations, but it may also be prepared in the manufacturing plant or the like, beforehand.

To improve workability in the construction site, at the step of carrying into the building site, after connecting between the inclined edges 10*b*, 20*b* of two single frame plates 10, 20 forming the above mentioned base unit U with the back plate 30 in the manufacturing plant or the like beforehand, assemblies may be carried into the construction site in a state where the above mentioned base units U are formed. Furthermore, after connecting a plurality of base units U without obstructing transportation or the like, assemblies may be carried into the building site.

It is preferable that, at the step of processing in the above mentioned manufacturing plant, mounting holes 11, 21 are formed at mounting positions of an axial screw 41 provided to a frame plate distance regulation body 40, such as "cone" described below, in each single frame plate 10, 20.

As described above, the single frame plates 10, 20 and the back plates 30 manufactured in the manufacturing plant or the like are installed at predetermined positions in the construction site, in the present embodiment, at a position where an outer wall is formed in the reinforced concrete construction, and are used as the formwork for concrete molding.

At the step of such installation operations, during operations in the construction site, first, the base units U are formed by connecting paired two single frame plates 10, 20 with the above mentioned back plates 30, and then a certain amount of the base units U without deteriorating workability in the installation and the like are connected with the back plates 30.

In the present embodiment, assembly operations are carried out by treating every remaining formwork 1 formed by combining a total of eight sets of the base units U, which are formed by connecting four sets of the base units at two upper and lower tiers as shown by way of example in FIG. 5, as one block.

Into the mounting holes 11, 21 provided in the single frame plates 10, 20 of the remaining formwork 1, the axial screw 41 which regulate a distance between the formwork and provided to the frame plate distance regulation body is inserted (in the present embodiment, cone 40). The cone 40 is attached to the concrete casting surface of the single frame plate 10, 20 by threadedly attaching a form tie 50 to the axial screw 41 protruding from a surface of the single frame plate 10, 20 (opposite to the concrete casting surface).

After the cone 40 and the form tie 50 are attached as described above, if necessary, vertical stiffeners 61, 62 are arranged at positions opposed to the back plate 30 connecting between the base units U and vicinities of the mounting positions of the form tie 50, respectively, and, further, horizontal stiffener 63 is attached via a double-recess washer 51 attached to the form tie 50 and the washer 51 is moved to the single frame plates 10, 20 side by fastening a nut 52 engaged threadedly to the form tie 50 to press the horizontal stiffener 63 to the vertical stiffeners 61, 62 and, by pressing the vertical stiffeners 61, 62 on the surface of the single frame plates 10, 20, deformation of the remaining formwork 1 caused by a pressure in the concrete casting is prevented.

The above mentioned vertical stiffeners 61, 62 and/or horizontal stiffener 63 may be temporarily connected to the back plate 30 by using a wood screw which passes through the stiffeners and arrive at the above mentioned back plate 30.

As described above, the remaining formwork 1 in which the reinforcement by the stiffeners 61 to 63 is completed, is stood at a predetermined position on the foundation by using a crane or the like, and the similarly-formed remaining formworks 1 are adjacently arranged in the width direction to connect the remaining formworks with the back plates 30 and to build common horizontal stiffeners 63. Also, if necessary, the remaining formwork 1 is connected and extended in the height direction, and the required area is covered with the remaining formworks 1 by repeating these operations.

When the mounting of the decorative remaining formworks 1 is completed to cover the outer wall of the concrete construction to be constructed as described above, arrangement of reinforcement necessary for the concrete casting surface of the decorative remaining formworks 1 is carried out (not shown), and one ends 70*a* of separators 70 are threadedly engaged to the cones 40 attached to the single frame plates 10, 20 and the cones 40 are further attached to the other ends 70*b* of these separators 70.

When the arrangement of reinforcement (not shown), and the attachment of the separator 70 and the cone 40 is completed, for example, a known formwork plywood 80 in which through-hole 81 is formed corresponding to the above mentioned mounting position of the cone 40, is arranged oppositely to the above mentioned decorative remaining formwork 1, the form tie 50 is threadedly engaged and fixed to the axial screw 41 of the cone 40 which passes through and protrudes from the above mentioned through-hole 81 formed in the formwork plywood 80.

If necessary, the vertical stiffener (not shown) is also attached to the surface (inside of the building) opposite to the concrete casting surface of the formwork plywood 80 and the washer (not shown) are attached to the form tie 50 to attach the horizontal stiffener (not shown), thus a mounting operation of the formwork is completed.

By repeating the above mentioned operations, the formwork is completely mounted over the necessary range, and then concrete is poured between the decorative remaining formwork 1 and the formwork plywood 80, thus a casting operation of the concrete is completed.

After the casting operation of the concrete is completed and the concrete is cured during a predetermined period, the washer 51, the form tie 50, the horizontal stiffener 63 and the vertical stiffeners 61, 62 are removed and the formwork plywood 80 provided on an inner wall is eliminated.

After the elimination of the formwork plywood 80, the cone 40 exposed by eliminating the formwork plywood 80 is further eliminated from the inner wall and, if necessary, mortar for hole filling is filled in recess formed on the inner wall surface due to elimination of the cone 40.

On the other hand, the decorative remaining formwork 1 provided on an outer surface of a concrete wall is just left as surface decoration of the structure without being eliminated.

Figure 8:
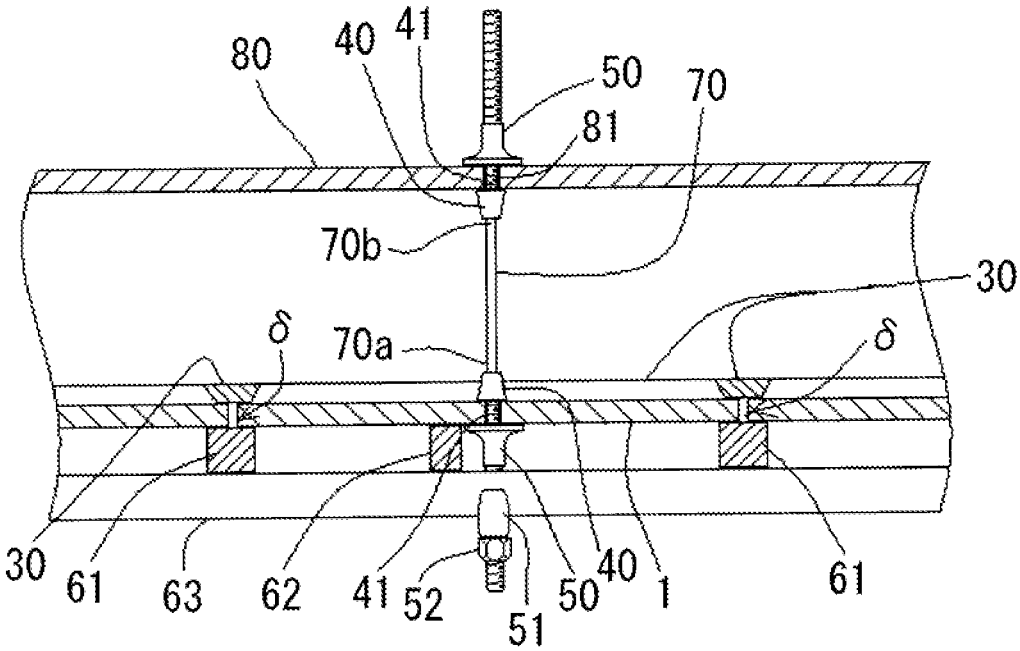
FIG. 8 is a plan cross-sectional view of a formwork using the decorative remaining formwork according to the present invention.
Figure 9:
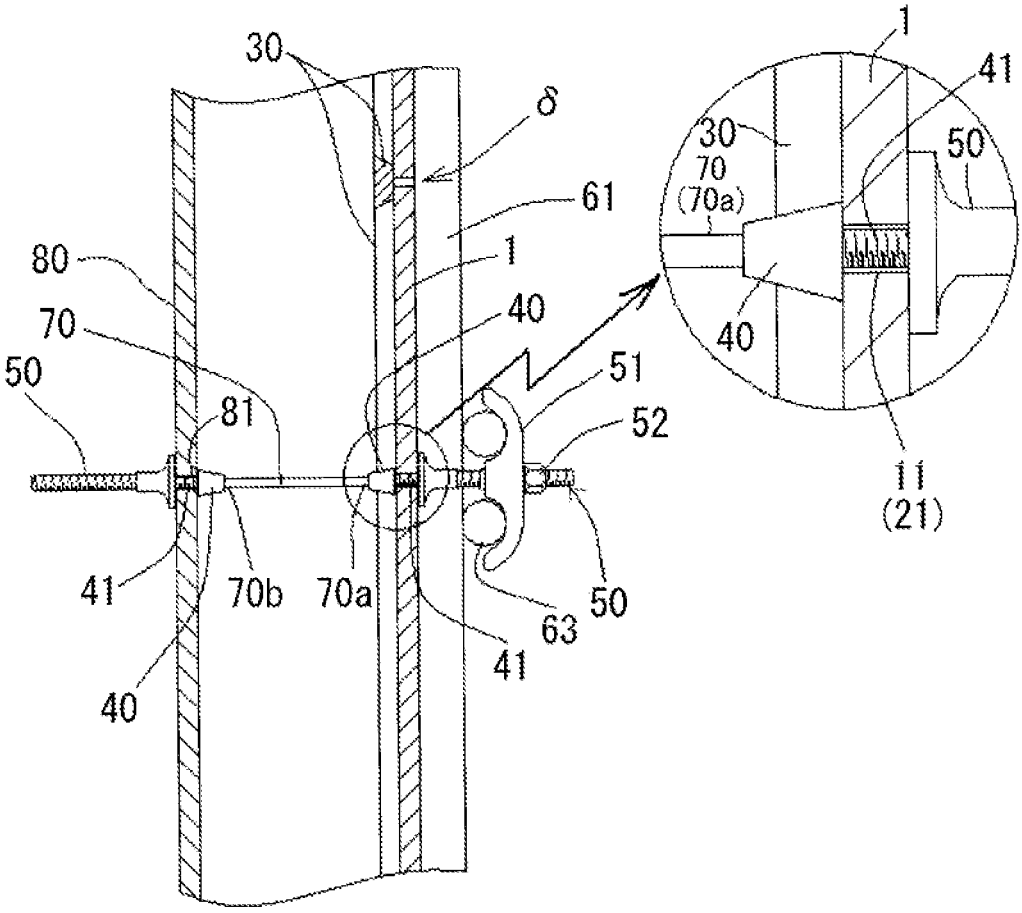
FIG. 9 is a side cross-sectional view of a formwork using the decorative remaining formworks according to the present invention.

In the decorative remaining formwork 1, the above mentioned back plate 30 connecting between the single frame plates 10, 20 is formed into a trapezoid in a cross section of a width direction thereof as shown in FIGS. 6, 8, and 9 and the trapezoidal short side is attached in contact with frame single elements 10, 20. Therefore, when the concrete is hardened in the state where the back plate 30 is buried into the cast concrete, the back plate 30 cannot be removed from the hardened concrete.

By the above mentioned constitution, in each single frame plate 10, 20 constituting the decorative remaining formwork 1, all edges are firmly fixed to the back plates 30, thereby the single frame plates 10, 20 are fixed extremely strongly to the wall surface.

When the washer 51, the form tie 50, the horizontal stiffener 63 and the vertical stiffeners 61, 62 are removed as described above, a nut (not shown) is threadedly engaged to the axial screw 41 of the cone 40 with which the form tie 50 was threadedly attached.

The nut (not shown) is threadedly engaged to the axial screw 41 of the cone 40 as described above, thereby the decorative remaining formwork 1 can be fixed to the separator 70 via the cone 40 by fastening the nut. As a result, the decorative remaining formwork 1 becomes harder to fall from the wall surface and the nut hides the axial screw 41 of the cone 40 to improve the appearance. In particular, when a cap nut is used as such nut, the decorative effect can be more improved.

TABLE: DESCRIPTIONS OF REFERENCE NUMERALS

1 Decorative remaining formwork
10 Single frame plate
10*a*, 10*e* Horizontal side
10*b* Inclined edge
10*c*, 10*d* Edge in the height direction
11 Mounting hole
20 Single frame plate
20*a*, 20*e* Horizontal side
20*b* Inclined edge
20*c*, 20*d* Edges in the height direction
21 Mounting hole
30 Back plate
31 Contact surface
32 Opposed surface
40 Frame plate distance regulation body (cone)
41 Axial screw
50 Form tie
51 Washer
52 Nut
61, 62 Vertical stiffener
63 Horizontal stiffener
70 Separator
70*a* One end (of separator)
70*b* Other end (of separator)
80 Formwork plywood
81 Through-hole
U Base unit
δ Gap The following claims do not indicate instruments, equipments, machines or apparatus, or steps or methods comprised of only the specific means disclosed herein. The claims are intended to protect heart or essence of this revolutionary invention. The present invention is clearly novel and useful.

Furthermore, at the point where the present invention is applied, the present invention is not obvious to those skilled in the art with reference to the conventional art, and further, considering the properties of the present invention which make a revolutionary change, the present invention is clearly a pioneering invention in the art. As a legal problem, the following claims must be construed extremely widely to protect the heart of the present invention.

Therefore, the object which becomes clear from the above mentioned description is accomplished effectively, and, in the above mentioned configuration, a certain degree of change can be made without departing from the scope of the present invention. Thus, all contents contained in the above mentioned description or the accompanying drawings are intended to be construed not in a limited sense but illustratively. It should be understood that the following claims are intended to include all of comprehensive and specific characteristics of the present invention described herein and that, as the issue of the language, all other expressions for the range of the present invention are within the claims.

The invention claimed is:

1. A decorative remaining formwork formed by combining a plurality of single frame plates defined by 3 or more edges comprising one edge arranged horizontally and at least one inclined edge inclined with respect to the horizontal edge, arranging the single frame plates so as to form a predetermined gap in a joint-shape between respective edges of the single frame plates adjacent each other, having a back plate on a concrete casting surface, the back plate covering the predetermined gap in a longitudinal direction, and being fixed to the single frame plate to connect the single frame plates adjacent each other, and a cross-sectional shape in a width direction of the back plate being formed into a shape enlarged from a contact surface with respect to the single frame plate toward an opposed surface with respect to the contact surface; and comprising a base unit formed by a combination of two single frame plates forming a rectangle shape by arranging the inclined edges in parallel via the predetermined gap, and having a pattern expressed by continuously arranging the base units in a predetermined direction or by continuously arranging the base units of which the directions are reversed and rotated or reversed or rotated in a predetermined pattern.

2. The decorative remaining formwork according to claim 1, further comprising a basic shape being defined as shapes of the two single frame plates constituting the base unit, and a component part composed of a single frame plate with a shape partially having a void in the single frame plate in the basic shape.

3. The decorative remaining formwork according to claim 2, wherein the single frame plate is a synthetic wood board obtained by forming synthetic resin filled with wood meals in a plate shape.

4. The decorative remaining formwork according to claim 2, wherein the back plate is a synthetic wood board obtained by forming synthetic resin filled with wood meals in a plate shape.

5. A wall surface structure of a concrete construction formed by using the decorative remaining formwork according to claim 2, wherein a surface of the concrete construction is covered with the decorative remaining formwork, and the back plate of the decorative remaining formwork is buried into a hardened concrete.

6. The decorative remaining formwork according to claim 1, wherein the single frame plates have a mixture of different colors.

7. The decorative remaining formwork according to claim 6, wherein the single frame plates adjacent each other have a uniform color to express a pattern by a combination of the single frame plates adjacent each other in the uniform color.

8. The decorative remaining formwork according to claim 1, wherein the single frame plate is a synthetic wood board obtained by forming synthetic resin filled with wood meals in a plate shape.

9. A wall surface structure of a concrete construction formed by using the decorative remaining formwork according to claim 8, wherein a surface of the concrete construction is covered with the decorative remaining formwork, and the back plate of the decorative remaining formwork is buried into a hardened concrete.

10. A wall surface structure of a concrete construction formed by using the decorative remaining formwork according claim 1, wherein a surface of the concrete construction is covered with the decorative remaining formwork, and the back plate of the decorative remaining formwork is buried into a hardened concrete.

11. The wall surface structure of the concrete construction according to claim 10, wherein the single frame plate is fixed to one end of a separator buried into the concrete of the concrete construction.

12. The wall surface structure of the concrete construction according to claim 11, wherein the single frame plate is fixed by threadedly engaging a nut to an axial screw of a frame plate distance regulation body, the frame plate distance regulation body being attached to one end of the separator, and the axial screw passing through and protruding from the single frame plate.

13. A wall surface structure of a concrete construction formed by using the decorative remaining formwork according to claim 11, wherein a surface of the concrete construction is covered with the decorative remaining formwork, and the back plate of the decorative remaining formwork is buried into a hardened concrete.

14. The decorative remaining formwork according to claim 1, wherein the back plate is a synthetic wood board obtained by forming synthetic resin filled with wood meals in a plate shape.

* * * * *

UNITED STATES PATENT AND TRADEMARK OFFICE

CERTIFICATE OF CORRECTION

PATENT NO. : 8,769,897 B2
APPLICATION NO. : 14/003839
DATED : July 8, 2014
INVENTOR(S) : Takeyasu Kikuchi et al.

It is certified that error appears in the above-identified patent and that said Letters Patent is hereby corrected as shown below:

IN THE SPECIFICATION:

Column 8, line 67, please delete "10," and insert --10, 20--

Column 10, line 60, please delete "10," and insert --10, 20--

Column 11, line 36, please delete "10," and insert --10, 20--

Signed and Sealed this
Thirteenth Day of January, 2015

Michelle K. Lee

Michelle K. Lee
*Deputy Director of the United States Patent and Trademark Office*